US005575674A

United States Patent [19]

Davis et al.

[11] Patent Number: 5,575,674

[45] Date of Patent: Nov. 19, 1996

[54] CONNECTOR ADAPTED FOR HERMAPHRODITIC CONSTRUCTION

[75] Inventors: Wayne S. Davis, Harrisburg; Michael E. Shirk, Grantville; Robert N. Whiteman, Jr., Middletown, all of Pa.

[73] Assignee: The Whitaker Corporation, Wilmington, Del.

[21] Appl. No.: 283,132

[22] Filed: Jul. 29, 1994

[51] Int. Cl.[6] ..... H01R 13/28

[52] U.S. Cl. ..... 439/284; 439/288; 439/347; 439/573

[58] Field of Search ..... 439/284, 286, 439/288, 347, 573, 247, 248

[56] References Cited

U.S. PATENT DOCUMENTS

| | | | |
|---|---|---|---|
| 4,335,931 | 6/1982 | Kinnear | 339/217 S |
| 4,630,876 | 12/1986 | Grunberg et al. | 339/48 |
| 4,647,130 | 3/1987 | Blair et al. | 339/64 M |
| 4,668,040 | 5/1987 | Matsuzaki et al. | 339/125 R |
| 4,737,118 | 4/1988 | Lockard | 439/289 |
| 4,808,115 | 2/1989 | Norton et al. | 439/79 |
| 4,975,062 | 12/1990 | Evans et al. | 439/288 |
| 4,990,099 | 2/1991 | Marin et al. | 439/284 |
| 5,030,121 | 7/1991 | Noorily | 439/188 |
| 5,098,311 | 3/1992 | Roath et al. | 439/289 |
| 5,106,320 | 4/1992 | Kinnear | 439/295 |
| 5,161,985 | 11/1992 | Ramsey | 439/284 |
| 5,167,528 | 12/1992 | Nishiyama et al. | 439/284 |
| 5,194,019 | 3/1993 | Rose | 439/573 |
| 5,228,873 | 7/1993 | Hirai | 439/573 |
| 5,249,983 | 10/1993 | Hirai | 439/573 |
| 5,282,757 | 2/1994 | Maeda | 439/374 |
| 5,328,380 | 7/1994 | Carney | 439/188 |
| 5,405,268 | 4/1995 | Gazzara et al. | 439/417 |

*Primary Examiner*—P. Austin Bradley
*Assistant Examiner*—T. C. Patel
*Attorney, Agent, or Firm*—Anton P. Ness

[57] ABSTRACT

An electrical connector (2) comprising: an insulating housing (3) a mating face (9) extending laterally and rearward of a front mating end (6), electrical contacts (4) along the mating face (9), the mating face (9) laterally overlapping a mating face (9) on a mating connector (2), and opposing fingers (7) on the two connectors (2) that press against each other to bias the mating faces (9) laterally toward each other during mating.

14 Claims, 5 Drawing Sheets

CONNECTOR ADAPTED FOR HERMAPHRODITIC CONSTRUCTION

FIELD OF THE INVENTION

The invention relates to an electrical connector, and, more particularly, to an electrical connector that pivots to mate with another electrical connector.

BACKGROUND OF THE INVENTION

According to U.S. Pat. No. 5,282,757, an electrical connector is adapted to move in a straight line to mate with another mating connector. When the connectors meet at an angle, corners on one of the connectors are cut out to prevent the corners from engaging and damaging electrical contacts in the mating connector. According to U.S Pat. No. 5,288,246, a guide pin on the connector aligns the connector with the mating electrical connector prior to alignment.

An electrical connector of hermaphroditic construction, for example, as disclosed in U.S. Pat. No. 4,990,099, comprises, a connector adapted for mating connection with another, duplicate connector of the same hermaphroditic construction.

SUMMARY OF THE INVENTION

An electrical connector is adapted to move angularly toward another mating electrical connector when the connectors are mated. Such a connector is useful for mounting against a mounting surface on an external object such as a circuit board or on a side of a hinged door. When the external object is pivoted, the electrical connector moves angularly together with the external object to mate with another electrical connector. In one application, a bin for storing a stack of paper currency is hinged to a machine into which a person inserts paper currency that the machine routes to the bin. For example, the machine comprises a gambling machine into which paper currency is inserted for the purpose of gambling. The machine may comprise a change machine into which paper currency is inserted for exchanging the paper currency for coins. An electrical connector on the bin activates an electronic lock when the bin is pivoted shut. The bin is hinged, such that when the bin is pivoted shut, the connector pivots with the bin to engage another mating electrical connector.

According to an embodiment of the invention, electrical contacts on an insulating housing extend along a mating face of an electrical connector, the mating face laterally overlaps a mating face on a second electrical connector to engage the contacts laterally side to side with additional contacts on the second electrical connector, at least one finger on said housing extends toward another finger on the second electrical connector, and the fingers laterally overlap each other when the mating faces laterally overlap.

According to an embodiment of the invention, the connector is suitable for hermaphroditic construction.

DESCRIPTION OF THE DRAWINGS

The invention will now be described with reference to the accompanying drawings according to which.

Figure 1:
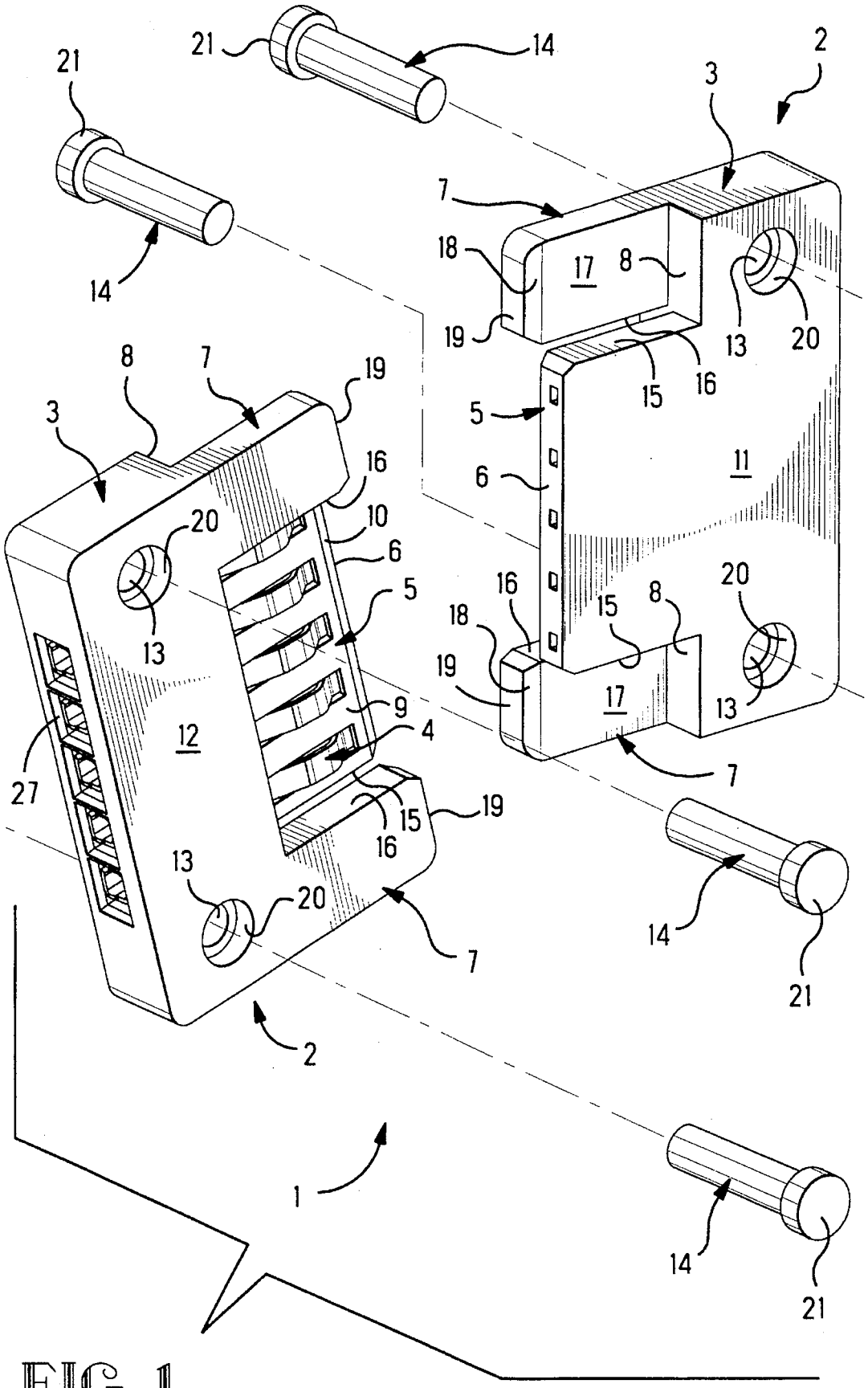
FIG. 1 is a perspective view of an electrical connector being pivoted to mate with another electrical connector.
Figure 5:
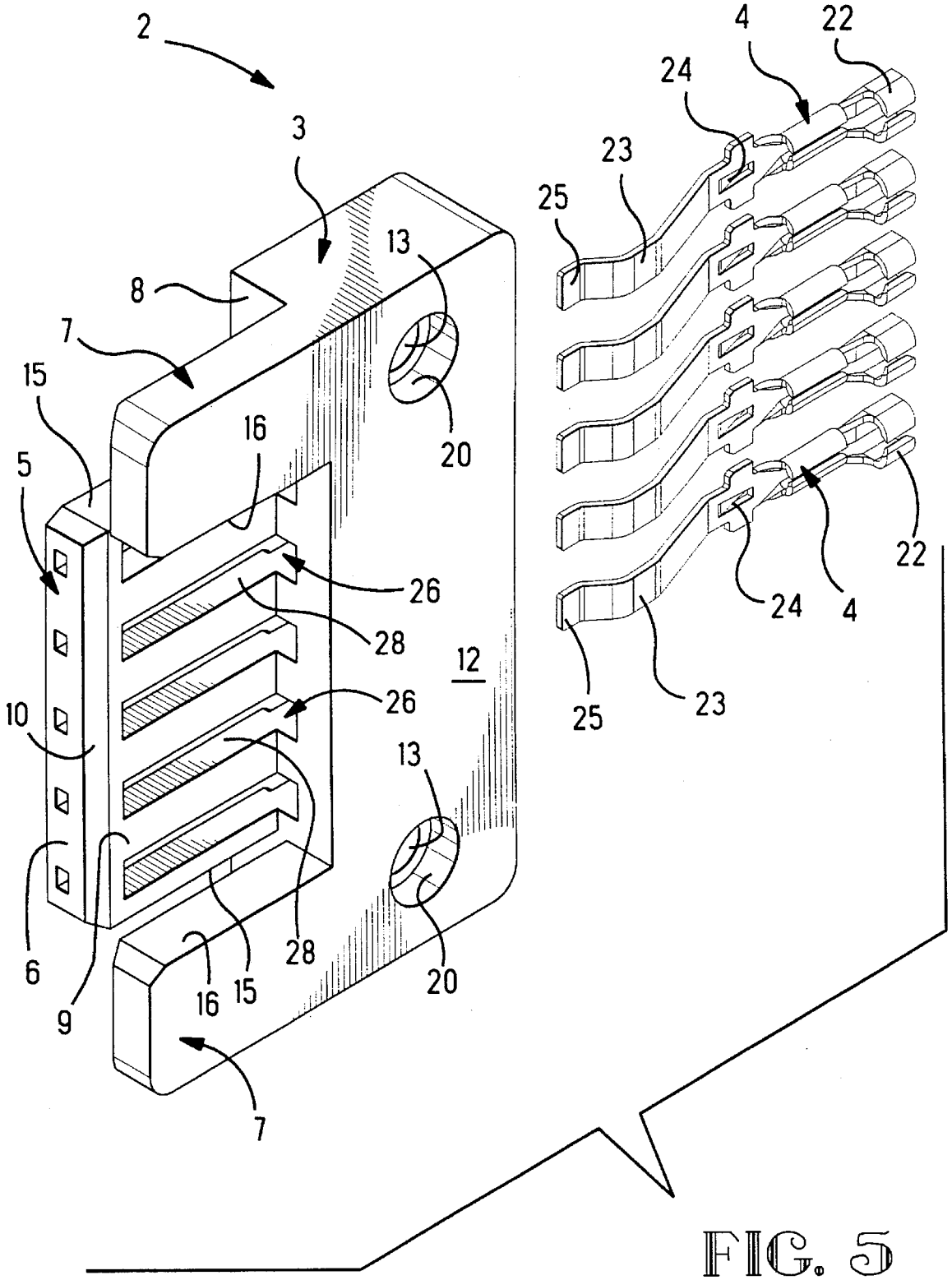
FIG. 5 is a perspective view illustrating one of the connectors with parts separated from one another.
Figure 6:
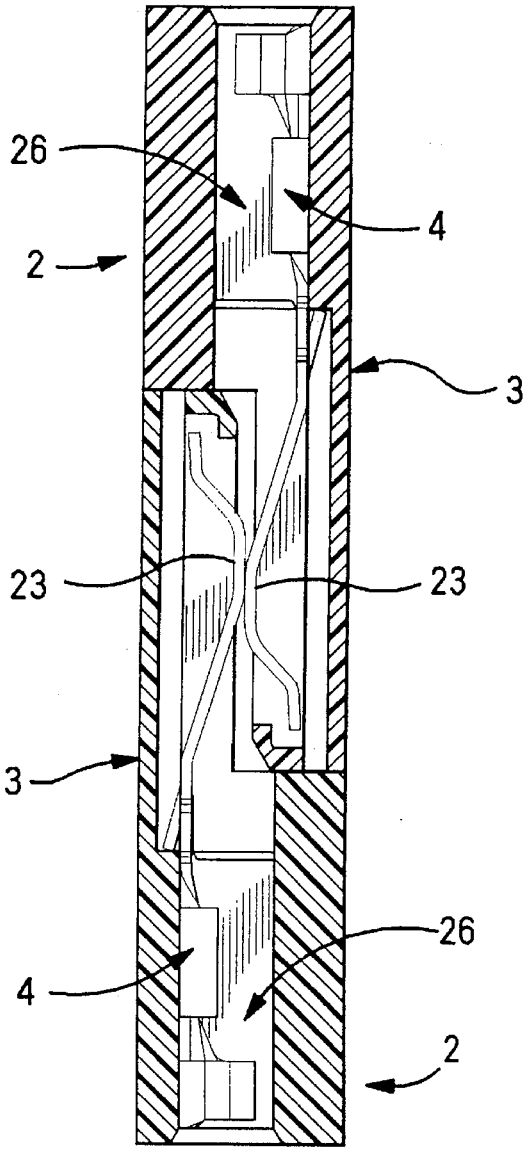
FIG. 6 is a longitudinal section view of the mated connectors shown in FIG. 4.

With more particular reference to FIGS. 1 and 5, an electrical connector assembly 1 comprises two electrical connectors 2 for mating together. Each of the connectors 2 are constructed similarly. Similar parts of the two connectors 2 will now be described with reference to each of the connectors 2 individually.

Each electrical connector 2 comprises, an insulating housing 3 and electrical contacts 4 on the housing 3. The contacts 4 are on a planar blade portion 5 on the housing 3 that extends toward a front mating end 6 of the housing 3. At least one planar guide finger 7 on the housing 3 extends toward a front of the housing 3. A finger receiving recess 8 beside the blade portion 5 is adapted to receive a guide finger 7 of a second housing 3 on the second connector 2. The guide finger 7 is beside the blade portion 5 to register in a finger receiving recess 8 of the second housing 3, and to guide the connector 2 during mating. A side mating face 9 of the housing 3 extends along one lateral side of the blade portion 5 of the same housing 3. The mating face 9 extends laterally and rearward of the mating end 6. The mating faces 9 of the two connectors 2 laterally overlap to engage said contacts 4 laterally side to side with one another. A bevel 10 extends along the front mating end 6 along each blade portion 5 and along the mating face 9. A base 11 on each housing 3 extends along the housing 3 and along a second lateral side of the blade portion 5. The side on which the base 11 is located is opposite the side on which the mating face 9 is located. The finger 7 on each housing 3 is elevated from the base 11. A second, auxiliary base 12 parallel to the first base 11, extends along the finger 7. Such a single finger 7 on the connector 2 adapts the connector 2 for hermaphroditic construction, whereby duplicated connectors 2 can mate with each other, as can be visualized by reference to FIG. 1. By visually turning one of the depicted connectors 2 front to rear, (but not side over side) the turned connector 2 having a single finger 7 becomes a duplicate of the second depicted connector 2 and matable therewith.

A second set of opposed guide fingers 7 on each of the two mating connectors 2 provide redundancy when guiding the connectors 2 during mating. Additionally, a second set of opposed fingers 7 will distribute biasing forces evenly over the mating faces 9 when the mating faces 9 are biased toward each other. Each finger 7 is in a different plane than the blade portion 5 on the same housing 3, and each finger 7 on one said housing 3 extends beside the blade portion 5 of another said housing 3 when the mating faces 5 laterally overlap to engage said contacts 4 side to side with one another. The second base 12 extends along each of the fingers 7 on the same connector 2. The two sets of opposed fingers 7 readily adapt the connectors 2 for hermaphroditic construction. The hermaphroditic construction can be visualized by reference to FIG. 1. By visually turning one of the depicted connectors 2 front to rear, the turned connector 2 becomes a duplicate of the second depicted connector 2. Also, by visually turning one of the depicted connectors 2 side over side, rather than front to rear, the turned connector becomes a duplicate of the second depicted connector.

Spaced apart pin receiving openings 13 extend through the bases 11, 12 on the housing 3. A pin 14 mounts in each opening 13 and attaches the housing 3 to a mounting surface, not shown, on an external object such as a circuit board or a hinged door, not shown. One of the connectors 2 can be mounted by the pins 14 rigidly in place, while the other connector 2 can be mounted by pivot type pins 14 for adjustable movement, as described hereinafter.

Figure 2:
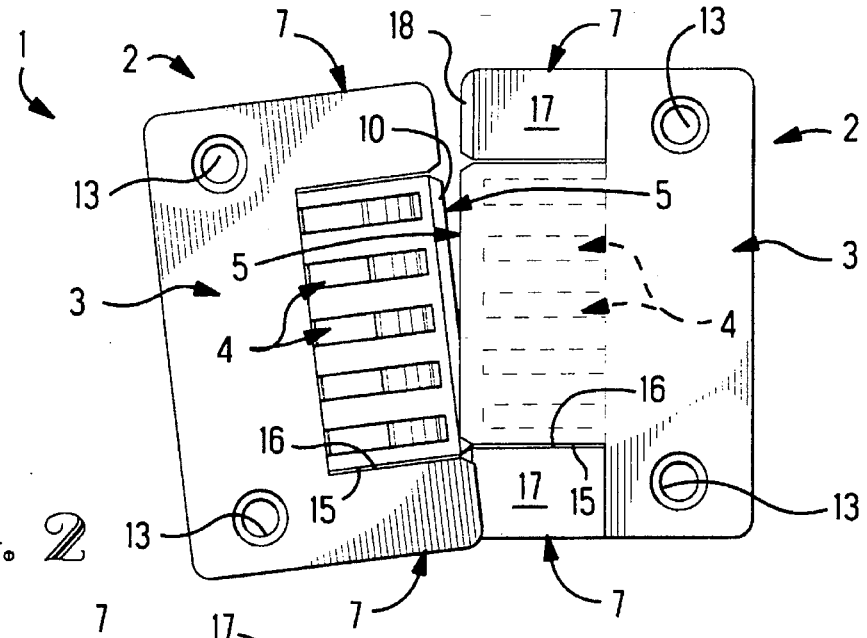
FIG. 2 is a plan view of the electrical connectors as shown in FIG. 1 engaging each other.
Figure 3:
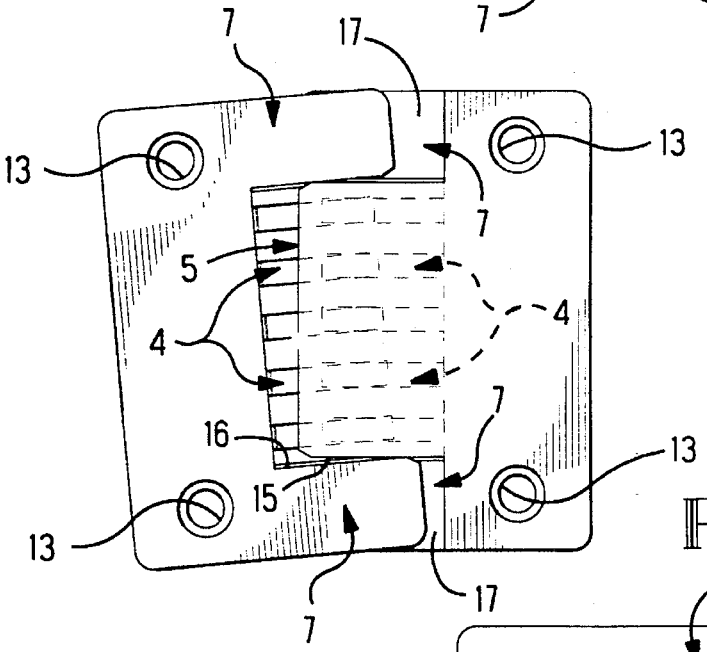
FIG. 3 is a plan view similar to FIG. 2, illustrating the connectors shown in FIG. 2 pivoting toward each other and being partially mated.
Figure 4:
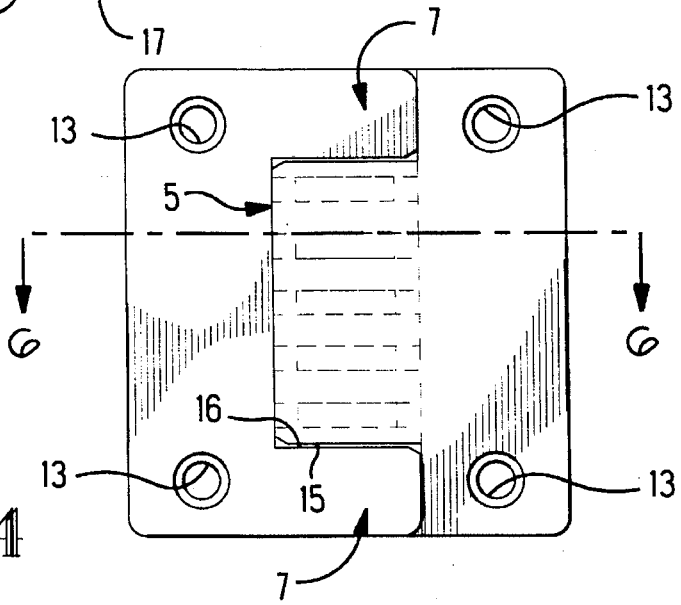
FIG. 4 is a plan view similar to FIG. 2, illustrating the connectors fully mated.

With reference to FIGS. 2 through 4, when the external object is pivoted, the one connector 2 is moved angularly relatively toward a second connector 2 to mate with the second connector 2, according to a sequence of events as depicted in FIGS. 2–4. The connectors 2 move angularly along an imaginary plane that is parallel to the mating faces 9 on the connectors 2. An opposed set of the fingers 7 on the connectors 2 oppose each other, and engage each other to guide the connectors 2 into alignment for mating. With reference to FIGS. 1 and 5, a lateral edge 15 on each blade portion 5 extends along each finger receiving recess 8. A front corner on the edge 15 is chamfered. With reference to FIGS. 2 through 4, when the connectors 2 are moved angularly relatively toward each other during mating, the lateral edge 16 on each finger 7 of a first connector 2 faces toward and by inherently adjusting their relative positions incrementally bears against a corresponding lateral edge 15 on a blade portion 5 of another connector 2 to guide the blade portion 5 during mating by inherently adjusting their relative positions incrementally. During mating, the blade portions 5 of the two connectors 2 pivot and slide against the lateral edges 16 on the fingers 7. The chamfers on the edges 15 and 16 allow the blade portions 5 and the fingers 7 to ride up and over the chamfers when the blade portion of one connector 2 is misaligned with each finger 7 on the other connector 2. The blade portions 5 angularly move over each other during mating, and the contacts 4 along the blade portions 5 engage one another and angularly move over one another during mating.

With reference to FIGS. 1 and 5, each of the fingers 7 has a side mating face 17 along a lateral side of the finger 7. The mating face 17 on the finger 7 faces in an opposite direction than that of the mating face 9 on the blade portion 5. The mating face 17 on one finger 7 faces toward and presses frictionally against a mating face 7 on a corresponding opposed finger 7 of a second connector 3. In turn, the mating faces 9 on the blade portions 5 are biased toward each other by the frictionally engaged fingers 7. Lateral sides on the contacts 4 on a first connector 2 are biased against respective lateral sides on the contacts 4 on the other connector 2 to maintain the contacts 4 in electrical connection with one another.

With reference to FIGS. 1 and 3, a beveled surface 18 extends along a front mating end 19 of each finger 7, and along the mating face 17 on the finger 7. During mating of the two connectors 2, the beveled surface 18 on each finger 7 on a first connector 2 faces toward an opposed finger 7 on the other connector 2. The mating face 17 on the opposed finger 7 rides up the beveled surface 18 and onto the mating face 17 on the finger 7 on the first connector, when the connectors 2 are misaligned.

Due to variations in dimensional tolerances, the connectors 2 may be misaligned such that when they meet during mating, frictional resistance to their mating is generated. The connectors 2 are mounted by the pins 14 in such a manner to allow the position of at least one of the connectors 2 to adjust when the connectors engage during mating, thereby to relieve frictional resistance to mating. The pins 14 can be shoulder pins 14 that are passed through the openings 13 of the housing 3. The shoulder pins 14 are then secured in the mounting surface of an external object, not shown, until a shoulder on each of the shoulder pins 14 impinges against the mounting surface of the external object to prevent tightening of the enlarged head on the shoulder pin 14 against the housing 3 of the connector 2. Thereby, the housing 3 is secured to the mounting surface but not tightly, allowing the housing 3 to move about the fulcrum. The diameter of the pills 14 can be selected so as to mount loosely in the relatively larger diameter of a corresponding opening 13. The pin 14 having a smaller diameter becomes a pivot pin. With reference to FIGS. 1 and 5, ends of the openings 13 are enlarged by enlarged counterbores 20. The remaining diameter of the opening 13 is larger than that of a shank on the pivot pin 14, and smaller that of an enlarged head 21 on the pin 14. The opening 13 provides a fulcrum on the housing 3. The contacts 4 and the finger receiving recess 8 and the guide finger 7 extend radially, respectively, from the fulcrum provided by the opening 13. Due to movement of the opening 13 about the smaller diameter shank, the fulcrum is allowed to shift with respect to the pivot pin 14, thereby to alleviate undue resistance to angular movement and mating of the connectors 2. Usually, only one of the connectors 2 will adjust in position. This will permit the other connector 2 to be rigidly mounted in place by respective pins 14. Usually, the one connector 2 will adjust in position relative to one fulcrum. The second fulcrum provides redundancy and will operate when needed, and when the first fulcrum is unable to adjust in position when resistance to mating is incurred. The contacts 4 and the finger receiving recess 8 and the guide finger 7 extend radially, respectively, from the second fulcrum provided by the second pivot pin receiving opening 13.

With reference to FIGS. 5, 7, 10 and 11, embodiments of the contacts 4 will be described, with similar parts being described by the same reference numerals. Each contact 4 is of unitary construction, stamped and formed from a strip of metal having a plane of thickness. Each contact 4 comprises, a rear electrical terminal portion 22 shaped in a barrel and adapted to encircle and connect to an insulated wire, not shown, an electrical contact surface 23 along a lateral side of the contact, a latch finger 24 projecting rearward diagonally out of the plane of thickness, and a front tip 25 of the contact.

With reference to FIGS. 6–9, the contact 4 is inserted into a rear of a contact receiving cavity 26 in the housing 3. At a rear of the housing the cavity appears as an opening 27, and forwardly along the mating face 9, the cavity appears as a groove 28. The contact surface 23 of the contact 4 is curved to project outward laterally of the groove 28 to engage a corresponding contact surface 9 on a contact in a second, mating connector 2, when two of the connectors 2 are mated together, FIG. 6. The latch finger 24 on each contact 4 faces an internal shoulder 29 in the cavity 26 to resist withdrawal of the contact 4 rearwardly.

Figure 10:
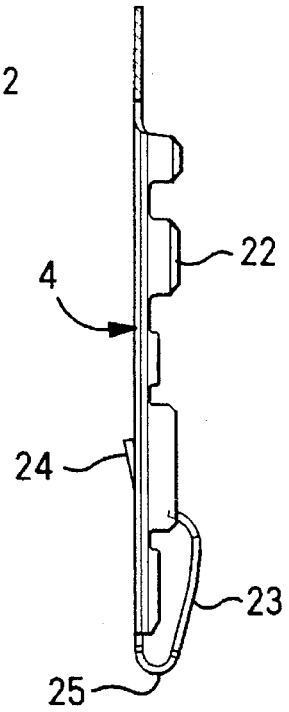
FIG. 10 is a side view of another embodiment of electrical contact.
Figure 11:
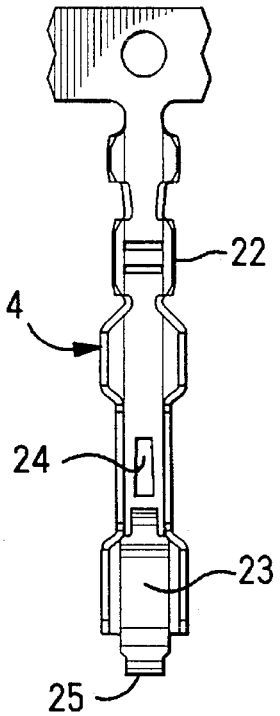
FIG. 11 is a plan view of the contact shown in FIG. 10.
Figure 7:
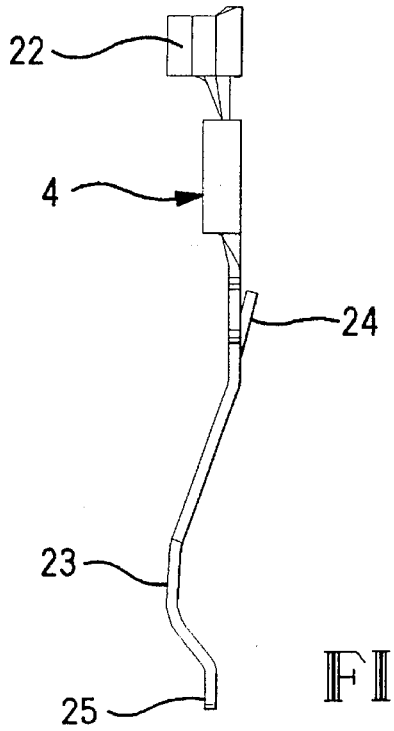
FIG. 7 is a side view of one electrical contact as shown in FIGS. 5 and 6.
Figure 8:
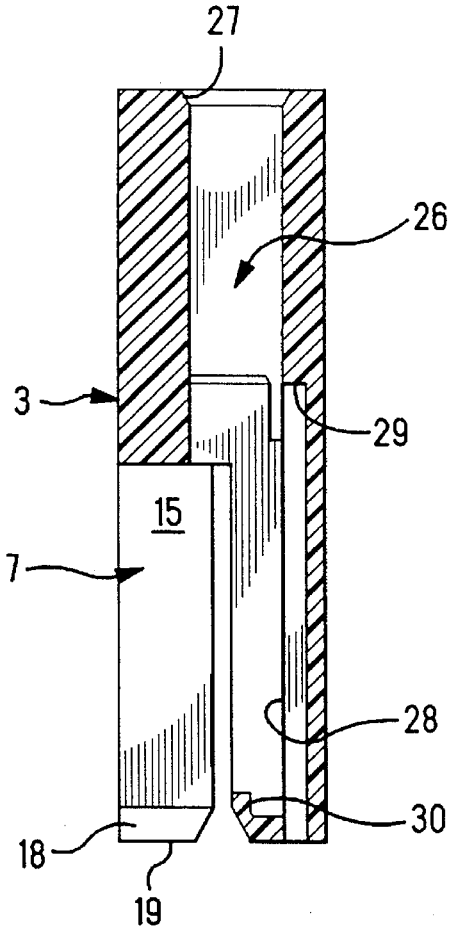
FIG. 8 is a section view of a housing as shown in FIG. 6.
Figure 9:
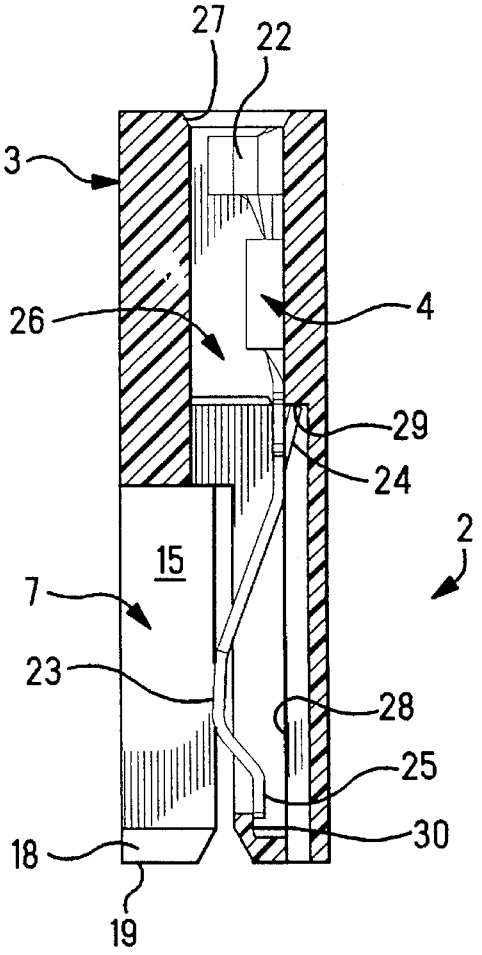
FIG. 9 is a section view similar to FIG. 8, illustrating an electrical contact in a housing.

Several features of the invention prevent stubbing of the contact 4 against the other connector 2, during mating. The tips 25 of the contacts depicted in FIG. 10 are curved and doubled on themselves to provide a rounded configuration to prevent stubbing. The tips 25 of the contacts depicted in FIGS. 5 and 7 are received under a lip 30, FIG. 9, at the front mating end 6 along the blade portion 5 to prevent such stubbing. The front mating end 6 along the blade portion 5 projects further forwardly in a direction toward the mating end 6 than the tips 25 on the contacts 4. Each finger 7 projects further forwardly in a direction toward the mating end 6 than the tips 25 of the contacts 4.

Other embodiments and modifications are intended to be covered by the spirit and scope of the appended claims.

We claim:

1. An electrical connector comprising:

an insulating housing and electrical contacts in the housing, wherein the contacts are on a blade portion that extends toward a front of the housing, the blade portion is beside a finger receiving recess adapted to receive a guide finger of another duplicate housing, and a guide finger is beside the blade portion to register in a finger receiving recess of another duplicate housing, the housing including a pair of openings extending through a body portion remote from the housing front for receipt of pins having shanks of smaller diameter than said openings and extending to leading ends adapted to be fastened to a panel thus enabling float mounting of the housing to the panel, such that said guide finger is receivable into a corresponding said finger receiving recess of said another housing and bears against bearing surfaces thereof to adjust the position of said housing incrementally laterally to precisely align said housing with said another housing.

2. A connector as recited in claim 1, and further comprising: a mating end of the housing, the finger projecting further forwardly in a direction toward the mating end than the contacts.

3. A connector as recited in claim 1, and further comprising: a mating end of the housing, the blade portion projecting further forwardly in a direction toward the mating end than the contacts on the blade portion.

4. A connector as recited in claim 1, and further comprising: a mating end of the housing, the finger projecting further forwardly in a direction toward the mating end than the contacts, and the blade portion projecting further forwardly in a direction toward the mating end than the contacts on the blade portion.

5. A connector as recited in claim 1, and further comprising: beveled surfaces extending along a mating of the finger, said beveled surfaces engaging a mating end on the finger of said another housing during pivotal movement of the beveled surfaces toward said mating end on said finger of said another housing.

6. A connector assembly comprising:

a pair of low profile insulating housings, having a low profile between opposed base surfaces orthogonal to mating ends thereof, thin blade portions extending to the mating ends on the housings, mating faces on first sides of the blade portions extending laterally and rearward of the mating ends, electrical contacts on the housings extending along the mating faces, the mating faces laterally overlap to engage said contacts laterally side to side with one another, and each housing including at least one thin finger laterally of the blade portion thereof extending to the mating end and a low height finger-receiving recess extending to the mating end along each said at least one finger adjacent the blade portion, whereby a low profile connector assembly is defined wherein the blade portions of the pair of housing overlap each other and each said at least one finger overlaps a finger of the other connector upon receipt into the low height finger-receiving recess.

7. A connector assembly as recited in claim 6, wherein the housings are of hermaphroditic construction.

8. A connector assembly as recited in claim 6, further comprising a second side of each blade portion, a first base on each housing extending along the second side, and each said at least one finger on each housing being elevated from the first base.

9. A connector assembly as recited in claim 8, comprising: a second base on each housing extending along the respective finger.

10. A connector assembly as recited in claim 8, comprising:

at least a first pivot pin receiving opening extending through one of said housings remote from the mating end thereof, and a pin extending therethrough having a shank of smaller diameter than said first opening and extending to a leading end adapted to fasten to a panel, whereby the housing is adapted to be mounted to a panel in a manner permitting incremental adjustment movement upon surfaces of said mating end engaging and bearing against corresponding surfaces of the other said housing at the mating end thereof during initial stages of mating, and thereby defining a float mounted low profile matable connector assembly.

11. A connector assembly as recited in claim 10, comprising:

a second pivot pin receiving opening in the housing having the first opening, and a pin extending therethrough having a shank of smaller diameter than Said second opening and extending to a leading end adapted to be fastened to a panel.

12. An electrical connector comprising:

an insulating housing, a mating end on the housing, a mating face on the housing extending laterally and rearward of the mating end, electrical contacts on the housing extending along the mating face, the mating face laterally overlapping a mating face on another insulating housing of another electrical connector to engage said contacts laterally side to side with additional contacts on said another insulating housing of said another electrical connector, at least one finger on said housing, the finger on said housing extending toward another finger on said another electrical connector, and the fingers laterally overlapping each other when said mating faces laterally overlap and on Opposite sides from those on which the mating faces overlap such that the connectors straddle each other.

13. An electrical connector as recited in claim 12 comprising: the housing being of hermaphroditic construction to provide said another electrical connector.

14. An electrical connector as recited in claim 13 wherein the finger on said housing extends beside the mating face on said another housing when the mating faces laterally overlap to move associated ones of said contacts superimposed against each other, and each finger presses laterally against the other finger to urge said blade portions toward each other and to urge said contacts toward and against each other.

* * * * *